US006050625A

United States Patent [19]

Nisbet

[11] Patent Number: 6,050,625

[45] Date of Patent: Apr. 18, 2000

[54] TABLE TENNIS BALL RETRIEVING AND DISPENSING SYSTEM

[76] Inventor: Charles Richard Nisbet, 21279 Entrada Rd., Topanga, Calif. 90290

[21] Appl. No.: 09/133,359

[22] Filed: Aug. 13, 1998

[51] Int. Cl.[7] ..... A63B 47/02

[52] U.S. Cl. ..... 294/19.2; 221/281; 221/303; 473/496

[58] Field of Search ..... 294/19.2; 221/191, 221/281–283, 285, 303; 473/286, 496; 224/919; 206/315.9

[56] References Cited

U.S. PATENT DOCUMENTS

| | | | |
|---|---|---|---|
| 2,569,007 | 9/1951 | Klyce | 473/496 |
| 2,760,807 | 8/1956 | Watson | 294/19.2 |
| 3,853,316 | 12/1974 | Smith | 473/496 |
| 3,901,545 | 8/1975 | Shott | 294/19.2 |
| 4,253,668 | 3/1981 | Ose | 294/19.2 |
| 4,629,235 | 12/1986 | Logue | 294/19.2 |
| 5,472,189 | 12/1995 | Pfeiffer et al. | 221/282 |
| 5,755,632 | 5/1998 | Eddy | 224/919 |
| 5,810,681 | 9/1998 | Heim | 294/19.2 |
| 5,820,499 | 10/1998 | Thomas et al. | 221/220 |

FOREIGN PATENT DOCUMENTS

| | | | |
|---|---|---|---|
| 2454-820 | 12/1980 | France | 294/19.2 |
| 3136-170 | 3/1983 | Germany | 294/19.2 |

*Primary Examiner*—Dean J. Kramer
*Attorney, Agent, or Firm*—J. E. McTaggart

[57] ABSTRACT

A system for managing table tennis balls facilitates retrieval of stray balls, stores them and dispenses them conveniently to a player as required. The system has two main components: a ball retriever, a.k.a. the BallSnatcher, and a storage rack, a.k.a. the BallFeeder. The tubular retriever can hold a column of balls and is deployed in a hand-held manner in a vertical orientation from a standing position. The retriever is fitted at its bottom end with a ball trap including (a) a flexible coaxial constriction ring defining an expandable entry opening that when lowered over a stray ball captures and retains it in the retriever tube, and (b) a flexible coaxial guidance flange extending outwardly and downwardly to provide initial guidance in retrieving a stray ball. The tubular storage rack is mounted below the playing surface of a game table at a low angle; an open upper end is located along one side of the table where it can receive balls in an easy transfer from the retriever, while the opposite lower end is fitted with an endstop/dispenser, located at an end of the table convenient to a player, that retains the balls in the rack and dispenses them one at a time as required for play. The storage tube is sized to receive the open top end of the retriever for ball transfer; furthermore, the retriever can inserted telescopically into the storage tube and left conveniently stored in this manner, ready to be easily pulled out for deployment.

17 Claims, 4 Drawing Sheets

TABLE TENNIS BALL RETRIEVING AND DISPENSING SYSTEM

FIELD OF THE INVENTION

The present invention relates to the field of racquet games, and more particularly, it is directed to the game of table tennis, disclosing a system for retrieving, storing and dispensing table tennis balls.

BACKGROUND OF THE INVENTION

It is inherent in the basic nature of the game of table tennis, a.k.a. ping-pong or Ping-Pong, that the ball often escapes from the playing table at the end of each round of play: whether playing indoors or outdoors there is a frequent need to retrieve stray balls, often from inaccessible locations such as under a sofa or in a flower garden. For many players, having to bend, squat or stoop to retrieve each stray ball manually from the floor or ground is excessively strenuous and/or tedious for their capability and/or liking, especially while they are involved in playing a game of table tennis.

Rather than interrupt the game each time a ball goes astray, or suspend play from time to time to retrieve the stray balls, many players prefer to keep the game going uninterruptedly by drawing from a reserve supply of balls and simply substituting a different ball whenever one goes astray. Searching for the stray balls may be delegated to others or postponed until after the game.

Keeping a reserve supply of balls ready for play creates a need for a device to store and dispense them conveniently; the expedient of using one's pockets for this purpose proves to be generally unsatisfactory due to the discomfort and untidy appearance of bulging pockets.

In retrieving the stray balls, since they usually land on the floor or on the ground, often in an inaccessible location, there is a need for a hand-held device to facilitate ball retrieval from a standing position and to temporarily hold an accumulated quantity of retrieved balls.

For a game in progress there is a need for a storage rack that is strategically located and that can store a supply of balls and dispense them conveniently to a player one at a time.

Furthermore there is a need for a convenient arrangement for transferring the retrieved balls from the retrieval device to the storage rack.

Finally there is a need to provide a convenient storage facility for the retrieval device when it is not in use.

DISCUSSION OF RELATED KNOWN ART

U.S. Pat. No. 3,853,316 to Smith discloses a table tennis ball holder, for attachment to the undersurface of a table tennis table, formed as a tubular shaped container which is squeezed to release a ball from a stored position.

U.S. Pat. No. 3,901,545 to Shott discloses a golf ball pickup device formed as a cylinder accommodating a stack of golf balls and having a pickup adaptor at the lower end configured with an enlarged entry tubular cylinder and a removable end cap at the upper end for release of the balls.

U.S. Pat. Nos. 5,292,161 and 5,433,491 to Green discloses ball pickup apparatus for tennis ball retrieval including a removable cap and containers that can be connected in multiples U.S. Pat. No. 4,058,336 to Parkinson discloses devices for picking up balls, such as golf balls, in the form of a tube of translucent plastic material, utilizing a pivoted constriction that is resiliently loaded so as to allow a ball to enter but not to exit an open end that is pushed over the ball.

U.S. Pat. No. 5,147,101 to Tiller discloses a golf ball dispensing and retrieving system formed as a tube which in a vertical orientation can pick up a golf ball at the tube's bottom end and add it to a captive stack retained by a capture constriction at the bottom end, and when oriented to a reverse low angle can be made to release balls from the aforementioned bottom end, the capture constriction action being modified by a gravity-dependent mechanism.

U.S. Pat. No. 5,188,410 to Summers discloses a deformable ball retrieving, retaining and dispensing device in the form of an elongated tubular member having sections that can be assembled/dissembled. Balls are retrieved at the lower end which includes a retaining mechanism so they can be stacked internally; they are dispensed from the upper end by inverting the tubular member.

U.S. Pat. Nos. 5,466,027 to Hockey and 5,755,632 to Eddy disclose tubular devices for retrieving and dispensing balls, including a mechanism at the lower end to pick up and retain a ball.

U.S. Pat. No. 5,472,189 to Pfieffer et al discloses a table tennis ball dispenser in the shape of an elongated tubular body providing openings for selectively receiving and withdrawing table tennis balls, the dispenser forming a part of one of the legs of a table tennis table.

U.S. Pat. No. 5,639,133 to Mote discloses an ergonomic ball retrieval tube and dispenser that picks up and retains balls at the lower end of a tube, and at the upper end provides a carrying handle and an enlarged storage compartment with a hinged lid.

OBJECTS OF THE INVENTION

It is a primary object of the present invention to provide a system for retrieving, storing and dispensing table tennis balls.

It is a further object in such system to provide a device for retrieving stray table tennis balls from a standing position.

It is a further object to provide a storage device for table tennis balls.

It is a further object to provide a simple method of transferring balls conveniently from the retrieving device to the storage device.

It is a further object to equip the storage device with a dispensing device for dispensing stored balls conveniently to a table tennis player.

It is a still further object to provide for storing the retrieving device in a convenient manner when it is not in use.

SUMMARY OF THE INVENTION

The above-mentioned objects have been accomplished by the present invention of two co-operating components:

(1) a ball retriever, a.k.a. the BallSnatcher, having as its main body an elongated retrieval tube, intended to be deployed manually in a vertical orientation from a standing position and sized internally to contain a column of table tennis balls, having at its bottom end a ball trap wherein a compliant constriction device extends inwardly defining a variable central entry opening that enables the capture of a stray tennis ball and its retention thusly accumulating a column of retrieved balls, and a flexible ball guidance flange extends outwardly and downwardly for facilitating the retrieval of stray table tennis balls; and (2) a storage rack, a.k.a. the BallFeeder, having as its main body an elongated storage tube, mounted to the game table and inclined at a low angle in a manner to receive balls at an elevated open end of the tube, and fitted at the opposite lower end with an endstop/dispenser which is located at an end of the table, enabling a player to conveniently pick up one ball at a time as required for play.

The storage tube is dimensioned to fit loosely over the retrieval tube in a telescopic manner, whereby the retriever may be stored in the rack. Due to this telescopic structure, the rack can serve its storage and dispensing functions equally well with or without the presence of a stored retriever; furthermore the retriever can always be stored in the rack even when there is a full row of balls stored there.

For retrieving balls, the retriever is removed from the rack empty of balls and is deployed in a hand-held manner, vertically oriented. The guidance flange at the bottom end of the retriever is lowered over a stray ball, urging it to the central entry opening where it is captured by lowering the retriever further so as to force the compliant constriction device downwardly past the ball and thus capture it in the bottom end of the retrieval tube. A succession of balls thusly captured become accumulated and stacked in a column in the retriever.

To transfer balls from the retriever, the open top end of the retriever is directed into the larger open upper end of the storage rack at the side of the table: the retriever can be pushed to a desired depth of insertion into the rack and left conveniently stored in this manner until the next usage. When needed, the retriever can be simply removed by pulling it out. Due to the slope of the rack, all of the stored balls remain there accumulated toward the endstop/dispenser at the low end, ready to be dispensed therefrom as required.

BRIEF DESCRIPTION OF THE DRAWINGS

The above and further objects, features and advantages of the present invention will be more fully understood from the following description taken with the accompanying drawings in which:

FIG. 1B, shows the flexible segmented constriction ring yielding as it is pushed downwardly past the ball.

FIG. 1C, shows the ball fully captured, retained and supported by the segmented constriction ring which has returned to its normal entry opening size.

FIG. 2A, shows the retriever having been elevated to transfer the retrieved balls to the rack and then having been telescoped partially into the rack where it may be left stored as shown.

DETAILED DESCRIPTION

Figure 1:
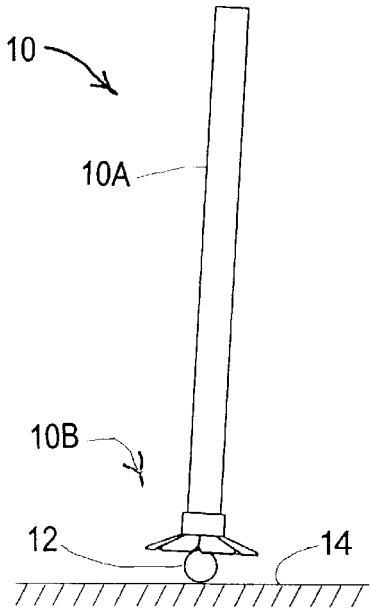
FIG. 1 is an elevational view showing a ball retriever of the present invention in a generally vertical orientation being deployed to retrieve a table tennis ball.

FIG. 1, a three-dimensional view, shows a retriever 10 of the present invention having as its main body a uniform elongated retrieval tube 10A sized internally to clear a table tennis ball 12 and having at its bottom end a coaxial ball trap 10B. Retriever 10 is deployed in a hand-held manner by a user from a standing position and is oriented in a generally vertical direction as shown for retrieving stray table tennis balls, such as ball 12 shown resting on a horizontal surface 14 such as a floor, patio, ground surface, etc.

Figure 1A:
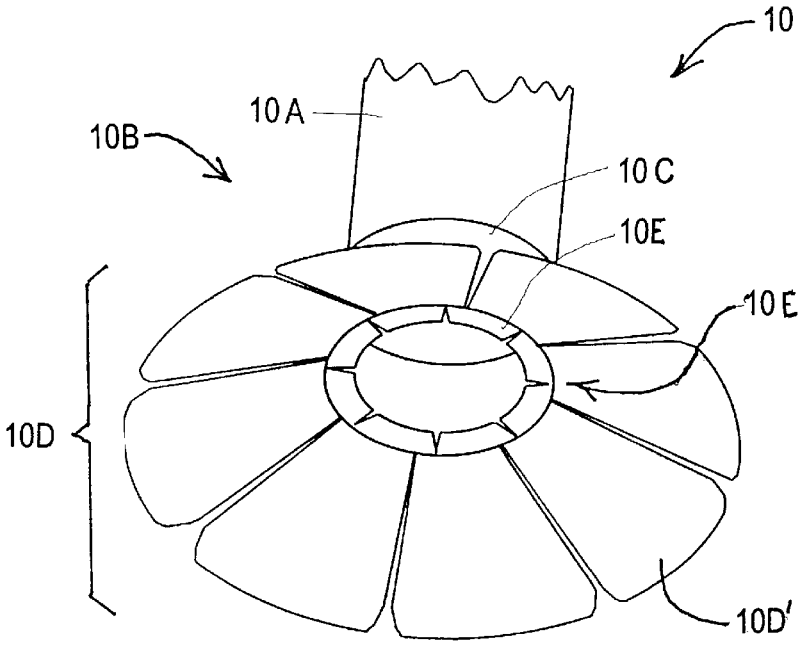
FIG. 1A is an enlarged three-dimensional view of the ball trap of the retriever of FIG. 1 as viewed from beneath showing the ball guidance flange and the circular entry opening defined by a segmented ring serving as the compliant constriction device for capturing balls.

FIG. 1A is an enlarged three-dimensional view of the bottom end of retriever 10 of FIG. 1, viewed from beneath, showing ball trap 10B attached to retrieval tube 10A by collar 10C. A flexible flange 10D extends outwardly and downwardly, and is preferrably configured with a polar array of 8 sectors 10D' separated by slots extending radially to the perimeter as shown.

At the bottom of retrieval tube 10A, a ball trap formed by a flexible constriction ring 10E extends inwardly so as to define an expandable entry opening, which in its normal unexpanded state is made 1.375" so as to be smaller than a table tennis ball (nominally 1.496", i.e. 38 mm). Constriction ring 10E is made flexible enough for the opening to expand as required to pass downwardly over a ball during capture, yet stiff enough to support a column of thusly captured balls when it reverts back to its normal state. In its preferred configuration, constriction ring 10E is configured with a polar array of six sectors 10E' separated by slots extending radiallly to the entry opening, as shown. Constriction ring 10E can be made flat or optionally inclined upwardly toward the central entry opening.

Configuring flange 10D and constriction ring 10E as separate segments in the crenelated array pattern shown increases their flexibility and enhances their functional performance. These segments are in effect resiliently hinged to the bottom end of the retrieval tube 10A and their hinge action may be further enhanced by decreasing the material thickness in the regions where these segments are attached to the lower end of retrieval tube 10A.

Guidance flange 10D and constriction ring 10E may be molded from flexible plastic or other suitable material along with collar 10C to form an integral ball trap 10B; alternatively, constriction ring 10E could be made as a separate part and fastened in place independently in the bottom end of retrieval tube 10A.

Figure 1B:
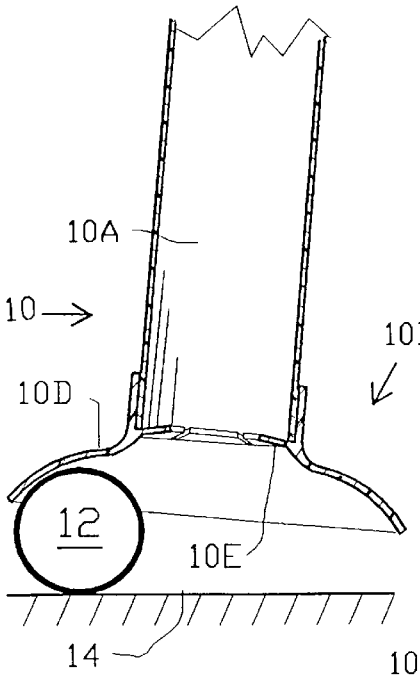
FIG. 1B is a cross-sectional view of a bottom portion of the ball retriever of FIG. 1, in an initial position about to retrieve a table tennis ball.

FIG. 1B is a cross-sectional view of the bottom portion of a retriever 10 of FIG. 1, showing ball trap 10B being lowered over a stray table tennis ball 12 on a floor 14, whereby flange 10D urges the ball 12 toward the central entry opening in constriction ring 10E.

Figure 1C:
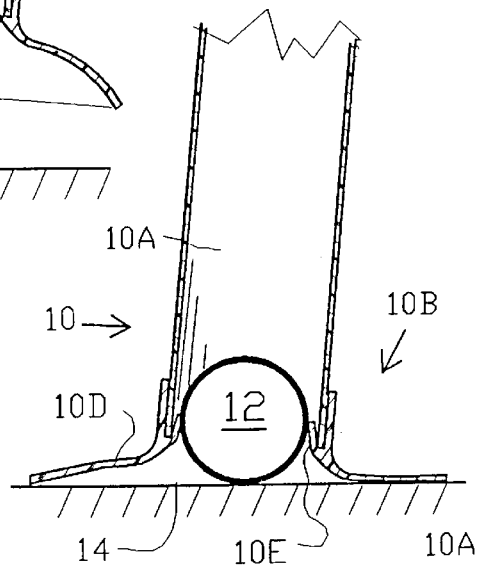
FIG. 1C, in sequence after

FIG. 1C, in time sequence after FIG. 1B, shows the flexible constriction ring 10E yielding as it is pushed downwardly over the ball; the entry opening expands sufficiently to move down past the ball 12; flange 10D is also required to yield as it pressed down against the floor 14.

Figure 1D:
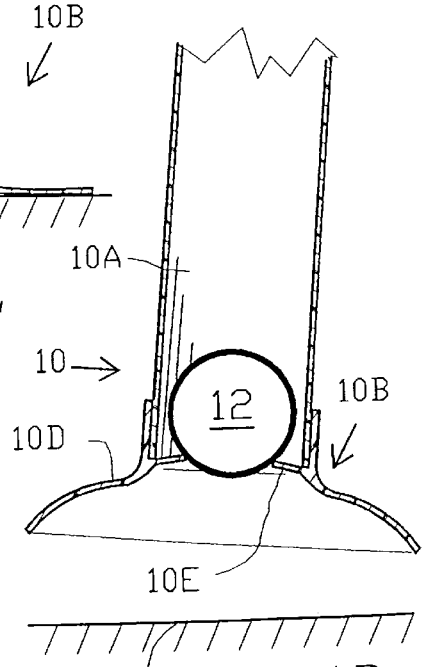
FIG. 1D, in sequence after

FIG. 1D, in time sequence after FIG. 1C, shows the ball 12 fully captured, constriction ring 10E having been pushed down further to where the entry opening diameter has returned resiliently to its original smaller size so that ring 10E now acts as a bottom stop supporting the ball 12 above it.

As the process in FIGS. 1B–D is repeated for each retrieved ball 12, the balls accumulate in a column above, supported by constriction ring 10E. With retrieval tube 10A made 33" in length, it can hold about 22 table tennis balls 12.

Figure 2A:
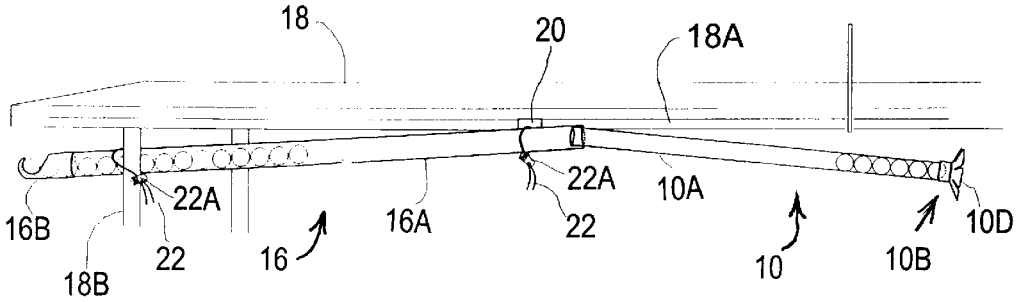
FIG. 2A is an elevational side view showing a retriever of the present invention, as in FIG. 1, initially inserted into the open end of the tube of a storage rack mounted to a table tennis table for the purpose of transferring retrieved balls to the rack.

FIG. 2A is an elevational side view showing a tubular storage rack 16 of the present invention attached to a game table 18; the open upper end of storage tube 16A of storage rack 16 is located outboard for loading convenience. Tube 16A passes immediately beneath the side rail 18A along one side of game table 18. Tube 16A is fastened to table 18 in a manner to slope downwardly from an open upper end located along one side of table 18, as shown, to a lower end portion which is fastened against the inboard side of a corner leg 18B of the table 18. The lower end of tube 16A, extending to the end of table 18 near the corner for player convenience, is fitted with an endstop/dispenser 16B from which stored balls are presented individually, available for game play.

Fastening of storage tube 16A may be implemented by commercially available fastening items, e.g. a pair of tie cords 22 that can be adjustably fastened in place by spring-loaded fasteners 22A; the upper open end may be suspended using a commercially available heavy duty spring-load paper clamp 20 fastened onto side rail 18A.

Retrieval tube 10A, shown also in FIGS. 1–1D, is shown partially inserted into the open end of storage tube 16A, in an initial engagement for the purpose of transferring the retrieved balls 12 to the storage rack 16 whose storage tube 16A is made sufficiently large in inside diameter to accept telescopic insertion of retrieval tube 10A in a loose fit.

Figure 2B:
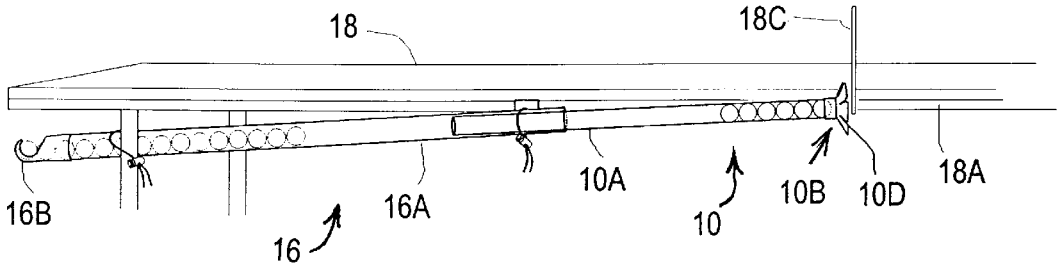
FIG. 2B, in sequence after

FIG. 2B, in a time sequence after FIG. 2A, shows the retrieval tube 10A elevated to line it up with storage tube 16A so that the retrieved balls 12 will roll downwardly into storage rack 16, where they will accumulate at the lower end, being constrained there by endstop/dispenser 16B. Retrieval tube 10A is shown telescopically inserted part way into storage tube 16, so that flange 10D is located in the region of the table 18 near the net 18C, where there is sufficient clearance from the edge rail 18A for flange 10D, and where it will not likely be struck with a ball or otherwise interfere with game play.

Figure 3:
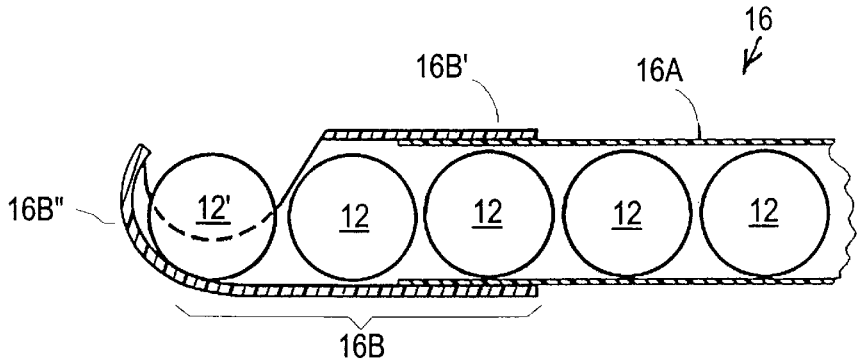
FIG. 3 is a central cross-sectional view showing a group of balls retained at the lower end of the storage rack, presented for play individually by the endstop/dispenser at the lower end of the rack.

FIG. 3 is a central cross-sectional view of the lower end portion of storage rack 16 showing storage tube 16A attached inside a collar portion 16B' of endstop/dispenser 16B showing a group of balls 12 stored therein, constrained by a from rolling any further downward and escaping to the left by an upward cup-shaped endstop 16B" formed on endstop/dispenser 16B which is further configured as shown with an upwardly-facing opening which presents the lowermost stored ball 12' to a player, thus dispensing balls 12 to a player one at time for game play.

Figure 4:
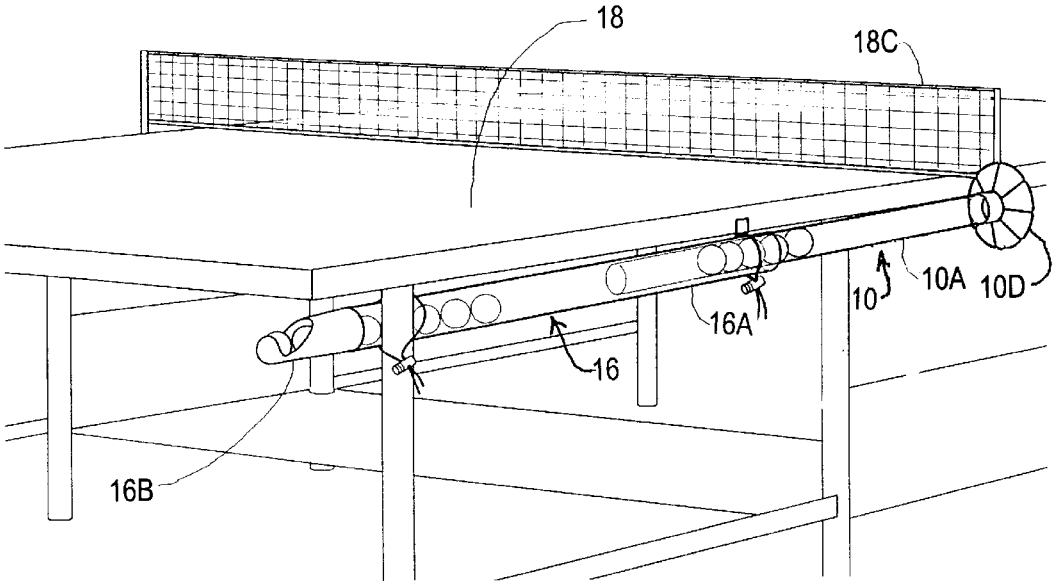
FIG. 4 is a three-dimensional view of a game table equipped with the system of the present invention, showing the retriever being stored in the rack as in FIG. 2B.

FIG. 4 is a three-dimensional view of the system of the present invention in place on a playing table 18 as in FIG. 2B. Typically there will be two tubular storage racks 16 deployed at diagonally opposite corners of table 18, so as to provide one for each player; a preferred system also includes two retrievers 10, one associated with each storage rack 16; however as a cost reduction alternative, a single retriever 10 could serve both storage racks 16.

In a preferred embodiment, dimensioning the o.d./i.d. of retrieval tube 10A to be 1.75"/1.625" provides clearance for table tennis balls 12 that are approximately 1.5" diameter. The guidance flange 10D is made 4.5" in diameter. Both the retrieval tube 10A and storage tube 16A are made from polycarbonate plastic, typically 33" long and having a wall thickness of 1/16, preferably made transparent so that contained balls can be seen. Making the o.d./i.d. of storage tube 16A to be 2.125"/2.0" provides a loose telescopic fit around retrieval tube 10A.

Referring again to FIGS. 2B and 4, it is seen that in its stored position the retriever 10 is only partially inserted into storage tube 16A: this locates flange 10D near the net 18C at the center of the table 18, where flange 10D is least obtrusive and unlikely to interfere with game play. Alternatively, a lower location of storage tube 16A could enable retriever 10 to be inserted further into storage tube 16A; however the resultant lowering of endstop/dispenser 16B would make its location less convenient.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A ball retrieval, storage and dispensing system for facilitating playing of table tennis on a game table, comprising:

a ball retriever, made and arranged to be deployed in a hand-held manner from a standing position for convenient retrieval of stray table tennis balls, having a) an elongated retrieval tube made and arranged to function in a generally vertical orientation for retrieving stray table tennis balls, said retrieval tube having a designated outside diameter and having an inside diameter sized to contain a column of table tennis balls with a working clearance, b) a ball trap, disposed at a bottom end of said retrieval tube, constructed and arranged to enable capture and retention of stray table tennis balls in said retrieval tube, in deployment of said ball retriever, and c) a flexible ball guidance flange, extending downwardly from the bottom end of said retrieval tube and extending outwardly therefrom to a perimeter having a diameter substantially greater than the outside diameter of said retrieval tube, said guidance flange being configured as a polar array of segments, separated by slots extending to an outer perimeter of said guidance flange and shaped to have a central cross-sectional shape that is curved in the general manner of an umbrella, forming a concave downward-facing cavity, coaxial with said retrieval tube, for enhancing ball retrieval by guiding a ball toward and into said ball trap; and a ball storage rack made and arranged to receive input of table tennis balls including easy transfer of retrieved balls directly from said ball retriever, to store the balls and to dispense the balls to a table tennis player in a convenient manner.

2. The ball retrieval, storage and dispensing system for table-tennis as defined in claim 1 wherein said ball trap comprises a compliant constriction device, disposed within said retrieval tube at the bottom end thereof, defining there an expandable entry opening having an effective normal diameter smaller than that of a table tennis ball, said constriction device being made sufficiently compliant to pass downwardly over a table tennis ball when so urged via said retrieval tube, and to thus enable the ball to enter the bottom end of said retrieval tube, said constriction device being made sufficiently firm to support a full column of balls contained in said retrieval tube.

3. The ball retrieval, storage and dispensing system for table-tennis as defined in claim 2 wherein said compliant constriction device comprises an annular ring of flexible material extending inwardly from the bottom end of said retrieval tube, defining the expandable entry opening.

4. The ball retrieval, storage and dispensing system for table-tennis as defined in claim 3 wherein said constriction ring is configured to extend upwardly as well as inwardly from the bottom end of said retrieval tube.

5. The ball retrieval, storage and dispensing system for table-tennis as defined in claim 3 wherein said constriction ring is configured as a polar array of segments separated by slots extending radially inwardly to the entry opening so as to increase compliance and thus facilitate operation of said ball trap.

6. The ball retrieval, storage and dispensing system for table tennis balls as defined in claim 2 wherein said compliant constriction device comprises an annular ring of flexible material extending inwardly from the bottom end of said retrieval tube, defining the expandable entry opening.

7. The ball retrieval, storage and dispensing system for table tennis balls as defined in claim 6 wherein said ball trap is formed as an integral unit comprising said guidance flange, said annular ring constituting said constriction device and a collar attached around a bottom region of said retrieval tube.

8. The ball retrieval, storage and dispensing system for table-tennis as defined in claim 7 wherein:

said constriction ring is configured as a polar array of segments separated by slots extending radially inwardly to the entry opening; and said ball guidance flange is configured as a polar array of segments separated by slots extending outwardly to a perimeter of said guidance flange;

whereby flexibility is increased in said constriction ring and said guidance flange so as to enhance ball trap performance.

9. The ball retrieval, storage and dispensing system for table tennis balls as defined in claim 1 wherein said table tennis ball storage rack comprises:

an elongated storage tube, made and arranged to accept table tennis balls for storage at an open entry upper end of said rack, said rack being disposed and supported so as to slope downwardly from the open end sufficiently to cause balls inserted into the upper open end thereof to roll toward the opposite low end thereof, said storage tube being made to have an inner diameter sized to accept entry of said retrieval tube and to enable a loosely fitting telescopic engagement therebetween; and an endstop/dispenser, disposed at the lower end of said storage tube, made and arranged to prevent escape of stored balls and to dispense the balls conveniently to a table tennis player for game purposes;

whereby a stack of retrieved balls in said retrieval tube may be transferred to said storage tube by inserting the top end of the retrieval tube into the open upper end of said storage tube and then elevating the bottom end of the retrieval tube tube so as to cause the balls to roll gravitationally into said storage tube and accumulate in a lower portion thereof, retained and presented for further game play by said endstop/dispenser.

10. The ball retrieval, storage and dispensing system for table tennis as defined in claim 9 wherein said retrieval tube and said storage tube are made from transparent plastic material.

11. The ball retrieval, storage and dispensing system for table tennis balls as defined in claim 9 wherein said endstop/dispenser is configured with a collar portion attached around said storage tube at the lower end thereof, a cup-shaped end stop that retains a row of stored balls in the inclined storage tube, and an upwardly-facing opening that dispenses stored balls to a player one at a time.

12. The ball retrieval, storage and dispensing system for table tennis balls as defined in claim 11 wherein said endstop/dispenser is configured and arranged with the upwardly-facing opening shaped so as to provide a cutaway region on each opposite side of said endstop/dispenser such that a lowermost ball in the row of stored balls can be easily grasped between a finger and a thumb and thusly selected for game use.

13. A ball retrieval, storage and dispensing system for table tennis comprising:

a ball retriever, made and arranged to be deployed in a hand-held manner from a standing position for convenient retrieval of stray table tennis balls, having a) an elongated retrieval tube made and arranged to function in a generally vertical orientation for retrieving stray table tennis balls, said retrieval tube having a designated outside diameter and having an inside diameter sized to contain a column of table tennis balls with a working clearance, b) a ball trap, disposed at a bottom end of said retrieval tube, constructed and arranged to enable capture and retention of stray table tennis balls in said retrieval tube, in deployment of said ball retriever, and c) a flexible ball guidance flange, extending downwardly from the bottom end of said retrieval tube and extending outwardly therefrom to a perimeter having a diameter substantially greater than the outside diameter of said retrieval tube, said flange being made and arranged to facilitate ball retrieval by guiding a ball toward and into said ball trap; and a ball storage rack made and arranged to receive input of table tennis balls including easy transfer of retrieved balls directly from said ball retriever, to store the balls and to dispense the balls to a table tennis player in a convenient manner, said ball storage rack comprising:

an elongated storage tube, made and arranged to accept table tennis balls for storage at an open entry upper end of said rack, said rack being disposed and supported so as to slope downwardly from the open end sufficiently to cause balls inserted into the upper open end thereof to roll toward the opposite low end thereof, said storage tube being made to have an inner diameter sized to accept entry of said retrieval tube and to enable a loosely fitting telescopic engagement therebetween; and an endstop/dispenser, disposed at the lower end of said storage tube, made and arranged to prevent escape of stored balls and to dispense the balls conveniently to a table tennis player for game purposes:

said storage tube being suspended near the upper end thereof from a side edge of the game table, extending outboard therefrom, and attached near the lower end thereof to a corner leg of the game table and disposed inboard of the leg so as to locate said endstop/dispenser conveniently near a playing position at an end of the table and to locate the open upper end of said storage tube so as to be easily accessible for receiving balls from said retrieval tube.

14. The ball retrieval, storage and dispensing system for table tennis balls as defined in claim 13 wherein said ball trap comprises:

a compliant constriction device disposed within said retrieval tube, at the bottom end thereof, defining there an expandable entry opening having an effective diameter smaller than that of a table tennis ball, said constriction device being made sufficiently compliant to pass downwardly over a table tennis ball when urged downwardly via said retrieval tube, and to thus enable the ball to enter the bottom end of said retrieval tube, said constriction device being made sufficiently firm to supportingly retain a full column of balls in said retrieval tube.

15. A ball retrieval, storage and dispensing system for table tennis played on a playing table, comprising:

an elongated ball retriever deployed in a hand-held manner while oriented in a generally vertical direction for retrieving stray table tennis balls and temporarily containing retrieved balls stacked inside, having a) a retrieval tube, having a bottom end and an open top end, dimensioned to have a designated outside diameter and to have an inside diameter that clears table tennis balls, b) a flexible coaxial guidance flange, extending downwardly and outwardly from the bottom end of the retrieval tube to a circular perimeter having a diameter at least twice the outside diameter of said retrieval tube, thus forming a downward-facing cavity region for providing guidance for ball retrieval, and c) a compliant constriction device, extending inwardly from the bottom end of said retrieval tube defining a compliant entry opening having, in a relaxed state, a diameter less than that of a table tennis ball, whereby a stray ball may be captured by forcing said constriction device downwardly over the ball so as to cause flexure of said constriction device that enlarges the entry opening sufficiently to allow the ball to enter said retrieval tube, said constriction device being made sufficiently firm to support a full column of balls in said retrieval tube;

an elongated storage rack supported from the playing table so as to slope downwardly from an open upper end sufficiently to cause balls inserted into the open upper end to accumulate toward the opposite lower end thereof, said storage rack being sized internally to accept entry of the open top end of said retrieval tube and to provide loose telescopic engagement therewith; and an endstop/dispenser, attached to a lower end of said storage rack and located at an end region of the playing table, configured with a cup-shaped endstop that retains table tennis balls at the lower end of said storage rack, and with an upwardly-facing opening that is configured and arranged to expose sufficiently large areas on each of two opposite sides of a lowermost ball that the ball can be easily grasped between a finger and a thumb and lifted out for game use;

said ball retrieval, storage and dispensing system being made and arranged to enable a stack of balls collected in said retriever to be easily transferred to said storage rack by inserting the top end of said retrieval tube into the open upper end of said storage rack and then elevating the bottom end of said retrieval tube sufficiently to cause the retrieved balls roll down into said storage rack and accumulate against said endstop/dispenser, available for game use.

16. The ball retrieval, storage and dispensing system for table-tennis as defined in claim 15 wherein:

said constriction device is configured as a polar array of segments separated by slots extending radially inwardly to the entry opening; and said ball guidance flange is configured as a polar array of segments separated by slots extending outwardly to a perimeter of said guidance flange;

whereby flexibility of said constriction device and of said guidance flange are increased so as to enhance ball trap performance.

17. A method of managing the retrieval, storage and in-play dispensing of table tennis balls, comprising the steps of:

(1) collecting stray balls from previous play with an elongated retriever deployed in a hand-held manner while oriented in a generally vertical direction, the retriever having an open top end and a bottom end fitted with a ball trap having an expandable entry opening formed by a flexible constriction device made and arranged to capture a ball when lowered thereover, thusly captured balls being accumulated in a column retained within the retriever;

(2) inserting the open top end of the retriever into an open entry end of an elongated storage rack that is attached to the game table so as to slope downwardly from the open entry end to a lower end, located at an end of the table and fitted with an endstop/dispenser;

(3) transferring the retrieved balls to the storage rack by elevating the bottom end of the retriever sufficiently to cause the balls to roll downwardly into the storage rack and accumulate in a lower portion thereof, retained there by the endstop/dispenser, which is located conveniently for a table tennis player and which is configured with an upwardly-facing opening to present a lowermost ball for game use; and (4) in game play, obtaining balls one at a time as required, from the endstop/dispenser.

* * * * *